US006375371B1

(12) United States Patent
Horsten et al.

(10) Patent No.: US 6,375,371 B1
(45) Date of Patent: Apr. 23, 2002

(54) NON-LABEL PRINTING PROCESS FOR DIRECT THERMAL IMAGING MATERIALS INCLUDING AN ORGANIC SILVER SALT

(75) Inventors: Bartholomeus Cyriel Horsten, Rumst; Guy Denis Jansen, Borsbeek; David Rosa Tilemans, Lier, all of (BE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/451,999

(22) Filed: Nov. 30, 1999

Related U.S. Application Data

(60) Provisional application No. 60/118,247, filed on Feb. 2, 1999.

(30) Foreign Application Priority Data

Nov. 30, 1998 (EP) ..... 98204017

(51) Int. Cl.[7] ..... B41J 2/36
(52) U.S. Cl. ..... 400/120.11; 347/191
(58) Field of Search ..... 400/120.01, 120.09, 400/120.11, 120.12, 120.13; 347/188, 191, 192, 193, 221; 430/348, 349

(56) References Cited

U.S. PATENT DOCUMENTS 5,527,758 A * 6/1996 Uyttendaele et al. ..... 503/201
5,682,194 A * 10/1997 Uyttendaele et al. ..... 347/221
5,710,095 A * 1/1998 Horsten et al. ..... 503/210
5,750,319 A * 5/1998 Horsten et al. ..... 430/346

FOREIGN PATENT DOCUMENTS

EP 0622217 11/1994
EP 0736799 10/1996
EP 0754564 1/1997

* cited by examiner

*Primary Examiner*—Ren Yan
(74) *Attorney, Agent, or Firm*—Leydig, Voit & Mayer, Ltd.

(57) ABSTRACT

A printing process for a substantially light-insensitive thermographic monosheet material having two edges parallel to one another and >12 cm apart (non-label) for obtaining a desired optical density and a desired colour tone comprising:

selecting a thermographic monosheet material, the selected thermographic monosheet material being a black and white thermographic monosheet material having a support and a thermosensitive element;

supplying image data to a processing unit of a thermal printer including a printhead having energizable heating elements arranged in a column C;

converting the image data which are not zero into at least one activation pulse per pixel to be printed;

energising the heating elements printing-line by printing-line adjacent to the selected substantially light-insensitive thermographic monosheet material thereby producing an image;

transporting the imaging material past and adjacent to the printhead in a transport direction with a transport system;

forming an image dot with a heat energy of 50 to 200 $mJ/mm^2$ of heating element surface area;

wherein the thermosensitive element contains a substantially light-insensitive organic silver salt, a reducing agent therefor in thermal working relationship therewith and a binder; and the thermosensitive element excludes a colourless or light coloured dye precursor and and also excludes an encapsulated organic silver salt in a heat-responsive microcapsule.

12 Claims, No Drawings

NON-LABEL PRINTING PROCESS FOR DIRECT THERMAL IMAGING MATERIALS INCLUDING AN ORGANIC SILVER SALT

The application claims the benefit of the U.S. Provisional Application No. 60/118,247 filed Feb. 2, 1999.

FIELD OF THE INVENTION

The present invention concerns a non-label-printing process for the printing of substantially light-insensitive thermographic monosheet materials.

BACKGROUND OF THE INVENTION

Thermal imaging or thermography is a recording process wherein images are generated by the use of thermal energy. In direct thermal printing a visible image pattern is produced by image-wise heating of a recording material e.g. image signals can be converted into electric pulses and then via a driver circuit selectively transferred to a thermal printhead, which consists of microscopic heat resistor elements, thereby converting the electrical energy into heat via the Joule effect. This heat brings about image formation in the thermographic material.

EP-A 754 564 discloses a heat sensitive recording material comprising a support and, provided thereon, a heat sensitive recording layer containing a colorless or light colored dye precursor and an electron accepting color developer which reacts with the dye precursor upon heating to cause color formation of the dye precursor, where the heat sensitive recording material contains at least one water-insoluble resin selected from the group consisting of an aromatic resin, a resin having a low or no acid value and a resin having a carbonyl group and an alicyclic unit. Different printing tests described in the invention examples of EP-A 754 564 disclose applied energy per unit area in the ranges of 20–140 mJ/mm$^2$, 80–140 mJ/mm$^2$, 30–50 mJ/mm$^2$, 80–100 mJ/mm$^2$, 30–35 MJ/mm$^2$ and 20–200 mJ/mm $^2$; as well as specific energies of 30 mJ/mm$^2$, 40 mJ/mm$^2$, 80 mJ/mm$^2$and 90 mJ/mm$^2$.

EP 736 799A discloses a recording material comprising a support having provided thereon at least a recording layer comprising (a) a heat-responsive microcapsule having encapsulated therein an organic silver salt; (b) a developer for the organic silver salt and (c) a water-soluble binder. A heat recording energy per unit area of 60 mJ/mm$^2$ is disclosed in the invention examples.

EP 622 217 discloses a method for making an image by means of a direct thermal imaging element, comprising on a support a thermosensitive layer containing an organic silver salt and a reducing agent, the imaging element being imagewise heated by means of a thermal head having energizable heating elements, characterised in that the activation of the heating elements is executed line by line with a line-duty-cycle A representing the ratio of activation time to total line time, according to the equation $$P \leqq P_{max} = 3.3 W/mm^2 + (9.5\ W/mm^2 x \Delta)$$

where $P_{max}$ is the maximal value over all heating elements of the time averaged power density P (expressed in W/mm$^2$) dissipated by a heating element during a line time.

A major problem with black and white substantially light-insensitive thermographic monosheet materials is the production of high densities with a sufficiently neutral image tone.

OBJECTS OF THE INVENTION.

It is therefore an object of the present invention to provide a non-label-printing process for producing prints with high densities and a more neutral image tone.

Further objects and advantages of the invention will become apparent from the description hereinafter.

SUMMARY OF THE INVENTION

It has been surprisingly found that the image density of black and white substantially light-insensitive thermographic monosheet materials is primarily dependent upon the heating energy used to produce a image dot, regardless of how the heating power is supplied.

The above-mentioned objects are realised by a printing process for a substantially light-insensitive thermographic monosheet material having two edges parallel to one another and >12 cm apart (non-label) for obtaining a desired optical density and a desired colour tone comprising:

- selecting a thermographic monosheet material, the selected thermographic monosheet material being a black and white thermographic monosheet material having a support and a thermosensitive element;
- supplying image data to a processing unit of a thermal printer including a printhead having energizable heating elements arranged in a column C;
- converting the image data which are not zero into at least one activation pulse per pixel to be printed;
- energising the heating elements printing-line by printing-line adjacent to the selected thermographic monosheet material thereby producing an image;
- transporting the selected thermographic monosheet material past and adjacent to the printhead in a transport direction with a transport system;
- forming an image dot with a heat energy of 50 to 200 mJ/mm$^2$ of heating element surface area;

wherein the thermosensitive element contains a substantially light-insensitive organic silver salt, a reducing agent therefor in thermal working relationship therewith and a binder; and the thermosensitive element excludes a colourless or light coloured dye precursor and also excludes an encapsulated organic silver salt in a heat-responsive microcapsule. With the black and white substantially light-insensitive thermographic monosheet material, a desirable colour tone is a neutral tone as defined by CIELAB a* and b*-values and a desirable optical density, $D_{vis}$ is above 1.2 and even more desirably above 1.5.

Preferred embodiments of the present invention are disclosed in the detailed description of the invention.

DETAILED DESCRIPTION OF THE INVENTION

Definitions

Certain terms used in disclosing the present invention are defined below.

A non-label for the purposes of the present invention is a sheet material having two edges parallel to one another and >12 cm apart. A preferred shape of non-label according to the present invention has two parallel edges separated by a distance of >12 cm measured perpendicular to the parallel edges.

Dot energy is the heating energy used to produce a dot.

A printhead PH comprises a t least one column C having a first number (e.g. s=3) of sections S, each section having a second number (e.g. se=10) of heating elements Hi.

Perceptible printed characters are composed of printed dots each dot representing a print pixel.

A line LL may be parallel or non-parallel to the direction of transportation of the substantially light-insensitive thermographic monosheet material. On a landscape non-label, for example, the line LL is substantially parallel to and on a portrait non-label the line LL is substantially perpendicular to the direction of transportation. Each line may be composed of a plurality of printing-lines PL. Examples of a printing-line PL are "----------" and "-- ---- -".

A printing-line PL is printed by a column C of heating elements Hi. The printing-line PL is substantially parallel to the column C; but the printing-line PL may be parallel or non-parallel to a line LL. Each printing-line is generated by a printing cycle of activation pulses in which all heating elements of a column can be activated at least once. The time taken to print a printing-line PL is a line-time LT.

Each activation pulse may either have an "off-state" (corresponding to a logical zero "0") or an "on-state" (corresponding to a logical one "1").

A line-duty-cycle Δ is the ratio of activation time to total line time for the heating elements which can be activated in producing a printing-line.

A printing-line may comprise several printing-sublines. Each printing-subline SL takes a time-slice or a time-step or a column-time (being the time wherein all heating elements of at least one section of a column can be activated once). A column-duty-cycle ▽ is the ratio of the sum of all activation-times during a column-time of all heating elements of a printing-subline divided by the column-time.

A transport system can consist of a moving belt, motor-driven drums, capstans etc.

Substantially light-insensitive means not intentionally light sensitive.

The descriptor aqueous in the term aqueous medium for the purposes of the present invention includes mixtures of water-miscible organic solvents such as alcohols e.g. methanol, ethanol, 2-propanol, butanol, iso-amyl alcohol etc.; glycols e.g. ethylene glycol; glycerine; N-methyl pyrrolidone; methoxypropanol; and ketones e.g. 2-propanone and 2-butanone etc. with water in which water constitutes more than 50% by weight of the aqueous medium with 65% by weight of the aqueous medium being preferred and 80% by weight of the aqueous being particularly preferred.

The encapsulated organic silver salt in a heat-responsive microcapsule disclosed in EP 736 799A whose use in the thermosensitive element of the present invention is preferably excluded has a wall which isolates the substances incorporated therein from the exterior at room temperature, but becomes permeable without being destroyed when pressure is applied or when heated. The microcapsule can be prepared by any of interfacial polymerization, internal polymerization and external polymerization. Interfacial polymerization comprises emulsifying a core substance comprising an organic silver salt that has been dissolved or dispersed in an organic solvent in an aqueous solution having a water-soluble polymer therein and then forming a polymer wall around the emulsified oil droplets of the core substance.

A leuco-dye is a colourless or weakly coloured compound derived from a dye. Colourless or light coloured dye precursor leuco-dye systems whose use in the thermosensitive element of the present invention is excluded include leuco triarylmethane, indolyl phthalide, diphenylmethane, 2-anilinofluoran, 7-anilinofluoran, xanthene and spiro compounds such as disclosed in EP-A 754 564.

By the term "heat solvent" in this invention is meant a non-hydrolyzable organic material which is in a solid state in the recording layer at temperatures below 50° C, but becomes a plasticizer for the recording layer when thermally heated and/or a liquid solvent for the organic silver salt or the reducing agent.

Non-label-printing

It has been surprisingly found that the image density and image tone of black and white substantially light-insensitive thermographic monosheet materials based on organic silver salts are critically dependent upon the conditions applying during image formation as can be seen from INVENTION EXAMPLES 12 to 33. The image density of a dot achieved with a black and white substantially light-insensitive thermographic monosheet material based on an organic silver salt appears surprisingly mainly to depend upon the heating energy applied to the adjacent heating element during the thermographic development process, the so-called dot energy. Since dot energy is the product of heating power and heating pulse-length, this implies that the image density is surprisingly almost independent of the heating power. Moreover, the heating power will largely determine the temperature attained by the heating element and hence that attained by the substantially light-insensitive thermographic monosheet materials based on an organic silver salt in proximity to the heating element during the thermal development process. This means that the image density is almost independent of the temperature attained by the black and white substantially light-insensitive thermographic monosheet material based on an organic silver salt in proximity to the heating element during the thermal development process. Furthermore this dot energy can be supplied to one or more heating elements activated to produce the dot with a particular image density i.e. the heating power (i.e. drive voltage squared divided by the heating element resistance) applied to the one or more heating elements, in one or more heat pulses and the duration of the one or more pulses.

To achieve a more neutral image tone it is preferred that for the particular dot energy required the heating power be as low as possible and the column-duty-cycle ▽ be as high as possible.

Above a threshold energy, INVENTION EXAMPLES 1 to 11 show that the image density increases with increasing dot energy up to a maximum image density. The dot energy corresponding to this maximum image density has been found to be dependent upon the choice of reducing agent for a particular organic silver salt, the choice of toning agent and the ratio of binder to organic silver salt in the thermosensitive element. At still higher energies the image density decreases with further increase in dot energy. For a given binder to organic silver salt ratio and given concentration of a particular reducing agent and toning agent, the image density potential of the material has been found mainly to depend upon the weight per unit area of substantially light-insensitive organic silver salt therein.

Non-label-printing Process

In the non-label-printing process of the present invention, the range of heat energy for the formation of an image dot is 50 to 200 mJ/mm$^2$, with 66 to 150 mJ/mm$^2$ of heating element surface area being preferred and 66 to 120 mJ/mm$^2$ of heating element surface area being particularly p referred.

The non-label-printing process preferably comprises the further step of selecting the supply-voltage which determines the heating power, the column-time and/or the column-duty-cycle ▽ for obtaining the optical density and the colour tone with the selected black and white thermographic monosheet material.

The operating temperature of common thermal printheads is in the range of 300 to 400° C. and the heating time per picture element (pixel) may be less than 10 ms, the pressure contact of the thermal printhead with the recording material being e.g. 200–1000 g/cm$^2$ to ensure a good transfer of heat. Activation of the heating elements can be power-modulated or pulse-length modulated at constant power. Image-wise heating of the direct thermal material can also be carried out using an electrically resistive ribbon incorporated into the material. Image- or pattern-wise heating of the thermographic monosheet material may also proceed by means of pixel-wise modulated ultra-sound.

In a preferred embodiment of the non-label-printing process of the present invention the energisable heating elements are grouped in at least two sections S. In a further preferred embodiment of the non-label-printing process of the present invention the printhead consists of more than one column of energisable heating elements. In a still further preferred embodiment of the non-label-printing process of the present invention the energising of the heating elements printing-line by printing-line is carried out section by section.

In another preferred embodiment of the non-label-printing process of the present invention, the heating power is as low as possible and the column-duty-cycle $\nabla$ is as high as possible in achieving a particular heat energy for the formation of the image dot. Possible embodiments of the invention having the same effect of lowering the power and increasing the duty cycle comprise e.g.: reducing the voltage and increasing the duty cycle while keeping the column-time constant; reducing the voltage and increasing the column-time while keeping the duty cycle constant; and reducing the voltage, increasing the duty cycle and increasing the column-time.

In another preferred embodiment of the non-label-printing process of the present invention, a configuration memory contains characteristics of at least one thermographic monosheet material relating to a range of available column-times, to a range of available transportation speeds, to a range of available voltages.

In another preferred embodiment of the non-label-printing process of the present invention the heating power per heating element is in accordance with $P \leqq P_{max}=3.3\ W/mm^2+(9.5\ W/mm^2 \times \nabla)$, where $P_{max}$ is the maximal value over all heating elements of the time averaged power density P (expressed in $W/mm^2$) dissipated by a heating element during the column-line-time.

In another preferred embodiment of the non-label-printing process of the present invention the column is at an angle to the transport direction of between 0 and 100°, with an angle between 90 and 99° being particularly preferred.

In yet another preferred embodiment of the non-label-printing process of the present invention selection of the supply-voltage, the column-time and/or the column-duty-cycle $\nabla$ for obtaining the optical density and the colour tone with the selected black and white thermographic monosheet material includes:

generating a signal indicative of the black and white thermographic monosheet material;

retrieving from the configuration memory values for the supply-voltage, for the column-time and for the column-duty-cycle $\nabla$ corresponding to the optical density and the colour tone for the selected black and white thermographic monosheet material.

Such selection could be achieved by switching port lines on the microprocessor to change the control reference voltage or feed back path in the power supply. Alternatively some sort of variable voltage regulator could be used.

Black and White Substantially Light-insensitive Thermographic Recording Material The black and white substantially light-insensitive thermographic recording material use in the present invention preferably has a numerical gradation value, NGV, of greater than 2.0, where the numerical gradation value is defined as:

$$NGV = \frac{\Delta OD\,[(0.9 + D\min)\text{ to }(0.1 + D\min)]}{\Delta\text{ dot energy difference for }\Delta OD\ (0.9 + D\min)\text{ to }(0.1 + D\min)} = \frac{(0.9 + D_{\min}) - (0.1 + D_{\min})}{E_{(0.9+D\min)} - E_{(0.1+D\min)}}$$

Thermosensitive Element

The black and white substantially light-insensitive thermographic monosheet material used in the present invention comprises a thermosensitive element containing a substantially light-insensitive organic silver salt, a reducing agent therefor in thermal working relationship therewith and a binder. This thermosensitive element excludes colourless or light coloured dye precursor leuco-dye systems and also excludes encapsulated organic silver salt in a heat-responsive microcapsule. Furthermore, the thermosensitive element may comprise a layer system in which the ingredients may be dispersed in different layers, with the proviso that the substantially light-insensitive organic silver salt and the reducing agent are in thermal working relationship with one another i.e. during the thermal development process the reducing agent must be present in such a way that it is able to diffuse to the substantially light-insensitive organic silver salt particles so that reduction of the substantially light-insensitive organic silver salt can take place.

Organic Silver Salts

Preferred substantially light-insensitive organic silver salts for use in the thermosensitive element of the black and white substantially light-insensitive thermographic monosheet material used in the present invention, are silver salts of aliphatic carboxylic acids known as fatty acids, wherein the aliphatic carbon chain has preferably at least 12 C-atoms, which silver salts are also called "silver soaps". Combinations of different organic silver salts may also be used in the imaging materials of the present invention.

Organic Reducing Agents

Suitable organic reducing agents for the reduction of the substantially light-insensitive organic silver salts are organic compounds containing at least one active hydrogen atom linked to O, N or C. The choice of reducing agent influences the thermal sensitivity of the imaging material and the gradation of the image. Imaging materials using gallates, for example, have a high gradation. In a preferred embodiment of the present invention the thermosensitive element contains a 3,4-dihydroxyphenyl compound in which a benzene ring substituted with any group in the 1-position is further substituted with hydroxy-groups in the 3- and 4-positions, the 3,4-dihydroxyphenyl compound being preferably selected from the group consisting of gallic acid derivatives, gallates, ethyl 3,4-dihydroxybenzoate, butyl 3,4-dihydroxybenzoate and 3,4-dihydroxybenzonitrile.

Binder

The thermosensitive element of the black and white substantially light-insensitive thermographic monosheet material used in the present invention may be coated onto a support in monosheet- or web-form from an organic solvent containing the binder dissolved therein or may be applied from an aqueous medium using water-soluble or water-dispersible binders.

Suitable binders for coating from an organic solvent are all kinds of natural, modified natural or synthetic resins or mixtures of such resins, wherein the organic heavy metal salt can be dispersed homogeneously or mixtures thereof.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatin and modified gelatins, such as phthaloyl gelatin, polysaccharides, such as starch, gum arabic and dextrin, and water-soluble cellulose derivatives. Suitable water-dispersible binders are any water-insoluble polymer.

As the binder to organic silver salt weight ratio decreases the gradation of the image increasing. Binder to organic silver salt weight ratios of 0.2 to 6 are preferred with weight ratios between 0.5 and 3 being particularly preferred.

The above mentioned binders or mixtures thereof may be used in conjunction with waxes or "heat solvents" to improve the reaction speed of the organic silver salt reduction at elevated temperatures.

Toning Agents

In order to obtain a neutral black image tone in the higher densities and neutral grey in the lower densities, the black and white substantially light-insensitive thermographic monosheet material used in the present invention may contain one or more toning agents. The toning agents should be in thermal working relationship with the substantially light-insensitive organic silver salt and reducing agents during thermal processing. Any known toning agent from thermography or photothermography may be used.

Stabilizers and Antifoggants

In order to obtain improved shelf-life and reduced fogging, stabilizers and antifoggants may be incorporated into the black and white substantially light-insensitive thermographic monosheet material used in the present invention. Suitable stabilizers compounds for use in the thermographic monosheet material used in the present invention are represented by general formula I:

(I)

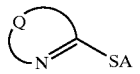

where Q are the necessary atoms to form a 5- or 6-membered aromatic heterocyclic ring, A is selected from hydrogen, a counterion to compensate the negative charge of the thiolate group or a group forming a symmetrical or an asymmetrical disulfide.

Surfactants and Dispersants

Surfactants and dispersants aid the dispersion of ingredients which are insoluble in the particular dispersion medium. The black and white substantially light-insensitive thermographic monosheet material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Other Ingredients

In addition to the ingredients the black and white substantially light-insensitive thermographic recording material used in the present invention may contain other additives such as free fatty acids, antistatic agents, e.g. non-ionic antistatic agents including a fluorocarbon group as e.g. in $F_3C(CF_2)^6CONH(CH_2CH_2O)$—H, silicone oil, ultraviolet light absorbing compounds, white light reflecting and/or ultraviolet radiation reflecting pigments, silica, and/or optical brightening agents.

Support

The support of the black and white substantially light-insensitive thermographic monosheet material used in the present invention may be transparent or translucent and is preferably a thin flexible carrier made transparent resin film, e.g. made of a cellulose ester, e.g. cellulose triacetate, polypropylene, polycarbonate or polyester, e.g. polyethylene terephthalate. The support may be in monosheet, ribbon or web form and subbed if needs be to improve the adherence to the thereon coated thermosensitive element. The support may be dyed or pigmented to provide a transparent coloured background for the image.

Protective Layer

In a preferred embodiment of the present invention a protective layer is provided for the thermosensitive element. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the black and white substantially light-insensitive thermographic monosheet material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

The following examples and comparative examples illustrate the present invention. The percentages and ratios used in the examples are by weight unless otherwise indicated.

INVENTION EXAMPLES 1 to 11

Preparation of the Thermosensitive Element

The subbed 63 μm thick polyethylene terephthalate support was doctor blade-coated with a composition containing 2-butanone as solvent/dispersing medium so as to obtain thereon, after drying for 1 hour at 50° C., a thermosensitive element with the composition:

| | |
|---|---|
| Silver behenate | 3.379 g/m$^2$ |
| PIOLOFORM ™ LL4160, a polyvinyl butyral from WACKER CHEMIE | 3.379 g/m$^2$ |
| BAYSILON ™ MA, a silicone oil from BAYER | 0.128 g/m$^2$ |
| 7-(ethylcarbonato)benzo[e][1,3]oxazine-2,4-dione, a toning agent | 0.189 g/m$^2$ |
| ethyl 3,4-dihydroxybenzoate, a reducing agent | 0.738 g/m$^2$ |
| tetrachlorophthalic anhydride | 0.203 g/m$^2$ |
| 3'-decanoylamino-1-phenyl-1H-tetrazole-5-thiol* | 0.073 g/m$^2$ |
| TINUVIN ™ 320 from CIBA-GEIGY | 0.129 g/m$^2$ |
| DESMODUR ™ N100, a hexamethylene diisocyanate from BAYER | 0.348 g/m$^2$ |

-continued

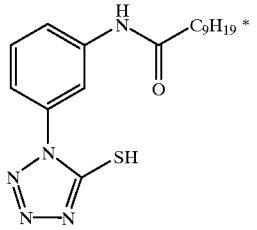

Overcoating of Thermosensitive Element with a Protective Layer

The above-described thermosensitive element was overcoated with a protective layer with the composition:

| | |
|---|---|
| PIOLOFORM ™ LL4160, a polyvinyl butyral from WACKER CHEMIE | 1.539 g/m$^2$ |
| BAYSILON ™ MA, a silicone oil from BAYER | 0.006 g/m$^2$ |
| MICRODOLT ™ SUPER, a talc from Norwegian Talc AS | 0.092 g/m$^2$ |
| TINUVIN ™ 320 from CIBA-GEIGY | 0.229 g/m$^2$ |
| TEGOGLIDE ™ 410 from Goldschmidt | 0.02 g/m$^2$ |
| DESMODUR ™ N100, a hexamethylene diisocyanate from BAYER | 0.154 g/m$^2$ |

Thermographic Printing

The thermographic printer used for printing the black and white substantially light-insensitive thermographic materials of INVENTION EXAMPLES 1 to 11 was a thermal head printer having a nominal resistance of 1850 ohms, 85 $\mu$m by 85 $\mu$m heating elements, with a line time of 11.5 ms and a process speed of 7.36 mm/s. The number of heating pulses, printhead voltages and pulse times were completely variable.

The printing was carried out with a single pulse per line time and at the voltages and pulse times given in table 1 below. The image density $D_{vis}$ and the CIELAB L*, a* and b* values determined in refection according to ASTM Norm E308 of the resulting prints are given in table 1 below.

TABLE 1

| | Printing conditions | | | | | | |
|---|---|---|---|---|---|---|---|
| Invention example | dot energy | printhead voltage | pulse-length | Print characteristics | | | |
| number | [mJ/mm$^2$] | [V] | [ms] | $D_{vis}$ | L* | a* | b* |
| 1 | 37.9 | 11.5 | 3.83 | 0.01 | 99.23 | −0.04 | 0.92 |
| 2 | 41.7 | 11.5 | 4.21 | 0.06 | 94.84 | 0.18 | 2.37 |
| 3 | 45.5 | 11.5 | 4.60 | 0.22 | 81.73 | 0.62 | 6.02 |
| 4 | 49.3 | 11.5 | 4.98 | 0.52 | 61.90 | 0.98 | 9.34 |
| 5 | 53.0 | 11.5 | 5.36 | 0.90 | 41.99 | 1.70 | 11.15 |
| 6 | 56.9 | 11.5 | 5.75 | 1.42 | 22.89 | 2.89 | 9.70 |
| 7 | 60.6 | 11.5 | 6.13 | 1.79 | 13.34 | 2.90 | 4.69 |
| 8 | 64.4 | 11.5 | 6.51 | 1.86 | 11.79 | 1.69 | 0.33 |
| 9 | 68.2 | 11.5 | 6.89 | 1.98 | 9.44 | 1.13 | −1.37 |
| 10 | 72.0 | 11.5 | 7.28 | 1.98 | 9.43 | 0.95 | −1.35 |
| 11 | 75.8 | 11.5 | 7.66 | 1.89 | 11.20 | 0.76 | −2.00 |

The experiments of INVENTION EXAMPLES 1 to 11 show an increase in image density D is with increasing dot energy. However, the D is value appears to stabilize and then decrease at the highest dot energies used. The L* value, a measure of the transmission of the layer decreases with increasing dot energy consistent with the increase in $D_{vis}$ Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming more yellow as b* becomes more positive.

The decrease in a* and b* values with increasing dot energy to values near zero for the highest dot energies used thus indicate that the image became more neutral with increasing dot energy.

The NGV-value of thermographic the recording material used in INVENTION EXAMPLES 1 to 11 was found to be 4.09, from the sensitometric curve formed by these INVENTION EXAMPLES.

INVENTION EXAMPLES 12 to 33

Direct Thermal Black and White Substantially Light-insensitive Thermographic Recording Material The direct thermal black and white substantially light-insensitive thermographic recording material used in the experiments of INVENTION EXAMPLES 12 to 33 was produced by coating the thermosensitive element overcoated with a protective layer used in INVENTION EXAMPLES 1 to 11 and coating the opposite side of the support to that coated with the thermosensitive element and its protective layer sequentially with a 5.5 g/m$^2$ coating of a white acrylic water-based ink pigmented with titanium dioxide having an optical density of 0.38 and overcoating with a white pressure sensitive water-based dispersion to a coating weight of 26 g/m$^2$, the two layers together having an optical density of 0.65. The second layer was then pressure laminated with the silicone-coated side of 65 g/m$^2$ glassine-based paper coated with a silicone layer, which acts as a release foil.

Thermographic Printer

The black and white substantially light-insensitive thermographic materials of INVENTION EXAMPLES 12 to 33 were printed with a thermal head printer, the thermal head having a nominal resistance of 102.6 ohms and 115 $\mu$m by 142 $\mu$m heating elements. It printed with a line time of 11.5 ms, was powered by six 1.5 volt batteries and had a DC-motor driven drum transport at a process speed of 7.3 mm/s with three heating pulses evenly distributed over the line time at the voltages and pulse times given in table 2. The image density $D_{vis}$ and the CIELAB L*, a* and b* values determined in refection according to ASTM Norm E308 of the resulting prints are given in table 2 below.

The results are arranged in the order of the dot energies used, independent of the heating power (quadratically dependent upon printhead voltage) and therefore of the temperature attained by the heating element and hence that obtained by the material local thereto. These results are surprising in two ways: in contrast to INVENTION EXAMPLES 1 to 11, the image density decreased with increase dot energy and furthermore despite considerable variations in temperature during the thermal development process due to the different heating powers used in the experiments of INVENTION EXAMPLES 12 to 33, the image density, $D_{vis}$ was found to be mainly dependent upon the dot energy applied, decreasing with increasing dot energy.

TABLE 2

| Invention example | Printing conditions: dot energy | printhead voltage | pulse-length | Print characteristics | | | |
|---|---|---|---|---|---|---|---|
| number | [mJ/mm$^2$] | [V] | [ms] | $D_{vis}$ | L* | a* | b* |
| 12 | 63.7 | 4.20 | 1.76 | 1.93 | 10.39 | −0.04 | 3.87 |
| 13 | 72.3 | 4.20 | 2.01 | 2.15 | 6.34 | 0.81 | −0.98 |
| 14 | 77.8 | 4.65 | 1.76 | 1.97 | 9.54 | 1.70 | −0.14 |
| 15 | 82.7 | 4.20 | 2.30 | 1.95 | 9.98 | 1.02 | −0.62 |
| 16 | 88.8 | 4.65 | 2.01 | 1.77 | 13.88 | 3.45 | 1.26 |
| 17 | 94.9 | 4.20 | 2.64 | 1.74 | 14.46 | 2.98 | 1.27 |
| 18 | 97.4 | 5.20 | 1.76 | 1.65 | 16.64 | 8.89 | 5.00 |
| 19 | 101.7 | 4.65 | 2.30 | 1.60 | 18.00 | 6.05 | 3.53 |
| 20 | 109.0 | 4.20 | 3.02 | 1.64 | 16.90 | 9.95 | 7.09 |
| 21 | 110.8 | 5.20 | 2.01 | 1.52 | 20.17 | 10.38 | 6.89 |
| 22 | 116.4 | 4.65 | 2.64 | 1.49 | 20.97 | 11.56 | 7.56 |
| 23 | 124.9 | 4.20 | 3.46 | 1.58 | 18.52 | 16.04 | 13.45 |
| 24 | 127.4 | 5.20 | 2.30 | 1.50 | 20.59 | 19.18 | 14.52 |
| 25 | 133.5 | 4.65 | 3.02 | 1.50 | 20.71 | 18.20 | 14.52 |
| 26 | 136.6 | 5.20 | 2.47 | 1.41 | 23.42 | 18.00 | 12.76 |
| 27 | 145.7 | 5.20 | 2.64 | 1.25 | 28.30 | 17.29 | 9.70 |
| 28 | 153.1 | 4.65 | 3.46 | 1.36 | 24.83 | 18.14 | 12.07 |
| 29 | 155.5 | 5.20 | 2.82 | 1.23 | 29.00 | 20.77 | 12.14 |
| 30 | 167.2 | 5.20 | 3.02 | 1.13 | 32.84 | 14.02 | 9.14 |
| 31 | 178.2 | 5.20 | 3.23 | 1.00 | 37.69 | 13.86 | 13.27 |
| 32 | 191.1 | 5.20 | 3.46 | 0.95 | 39.80 | 13.06 | 11.07 |
| 33 | 204.5 | 5.20 | 3.70 | 0.86 | 43.94 | 11.81 | 17.49 |

Furthermore, L*, a* and b* were also found to be dependent upon the dot energy, L* increasing with increasing dot energy, indicating decreasing optical density, and a* and b* increasing with increasing dot energy from values in the region of zero indicating colour neutrality at lower dot energies to increasingly less neutral colour tone with increasing dot energy.

INVENTION EXAMPLES 34 to 51

Influence of Number of Pulses and Heating Power at Constant Dot Energy

The dot energies for INVENTION EXAMPLES 14 & 15 were approximately 80 mJ/mm$^2$, those for INVENTION EXAMPLES 20 & 21 were approximately 110 mJ/mm$^2$, those for 23 & 24 were approximately 126 mJ/mm$^2$ and those for INVENTION EXAMPLES 28 & 29 were approximately 154 mJ/mm$^2$. These INVENTION EXAMPLES show that the dot energy is the principal determinant of the image density, $D_{vis}$ INVENTION EXAMPLES 34 to 51 were carried out on the same material as that used for INVENTION EXAMPLES 1 to 11 at a dot energy per pixel of approximately 74 mJ/mm$^2$ with the thermographic printer also used for INVENTION EXAMPLES 1 to 11. In these experiments the number of pulses (evenly distributed over the line time of 11.5 ms), the pulse-length and the heating power was varied with a single pulse being used in INVENTION EXAMPLES 34 to 39, two pulses being used in INVENTION EXAMPLES 40 to 45 and three pulses being used in INVENTION EXAMPLES 46 to 51. The image density attained in INVENTION EXAMPLES 34 to 51 approximately corresponds to the maximum image density attained in the experiments of INVENTION EXAMPLES 1 to 11.

INVENTION EXAMPLES 34 to 39 were carried out by providing the heating energy in a single equi-energetic pulse at different heating powers and hence pulse-lengths. The $D_{vis}$, L*, a* and b* values obtained under the different printing conditions are summarized in table 3.

TABLE 3

| Invention example | Printing with one heating pulse/line time: heating power | printhead voltage | pulse-length | Print characteristics | | | |
|---|---|---|---|---|---|---|---|
| number | [W/mm$^2$] | [V] | [ms] | $D_{vis}$ | L* | a* | b* |
| 34 | 24.2 | 18.0 | 3.06 | 2.32 | 4.29 | 0.70 | −0.26 |
| 35 | 21.6 | 17.0 | 3.45 | 2.29 | 4.58 | 0.79 | −0.28 |
| 36 | 18.4 | 15.7 | 4.00 | 2.28 | 4.57 | 1.26 | 0.08 |
| 37 | 14.7 | 14.0 | 5.00 | 2.23 | 5.22 | 0.84 | −0.15 |
| 38 | 12.9 | 13.1 | 5.75 | 2.24 | 4.99 | 1.32 | 0.31 |
| 39 | 9.83 | 11.5 | 7.66 | 2.21 | 5.58 | 0.61 | −0.88 |

Little variation in print characteristics was observed. However, if the heating energy was provided in two heating pulses evenly distributed over the line time of 11.5 ms (INVENTION EXAMPLES 40 to 45), the $D_{vis}$, L*, a* and b* values shown in table 4 were obtained.

TABLE 4

| Invention example | Print with two heating pulses per line time: heating power | printhead voltage | pulse-length | Print characteristics | | | |
|---|---|---|---|---|---|---|---|
| number | [W/mm$^2$] | [V] | [ms] | $D_{vis}$ | L* | a* | b* |
| 40 | 24.2 | 18.0 | 1.53 | 2.13 | 5.95 | 5.43 | 3.03 |
| 41 | 21.6 | 17.0 | 1.73 | 1.99 | 7.77 | 9.62 | 5.02 |
| 42 | 18.4 | 15.7 | 2.00 | 2.10 | 6.32 | 5.81 | 2.87 |
| 43 | 14.7 | 14.0 | 2.50 | 2.24 | 4.88 | 2.77 | 1.18 |
| 44 | 12.9 | 13.1 | 2.88 | 2.32 | 4.25 | 0.84 | −0.03 |
| 45 | 9.83 | 11.5 | 3.83 | 2.39 | 3.58 | 0.59 | −0.02 |

In printing with two heating pulses per line time a significant increase in image density $D_{vis}$, was observed upon reducing the heating power and concomitantly increasing the pulse-length. In addition a considerable improvement in the image tone neutrality was observed, as seen by the decrease in a*- and b*-values to values close to zero, upon reducing the heating power and concomitantly increasing the pulse-length.

INVENTION EXAMPLES 46 to 51, the heating energy was provided in three heating pulses evenly distributed over the line time of and the $D_{vis}$, L*, a* and b* values shown in table 5 were obtained. $D_{vis}$, L*, a* and b* values shown in table 5 varied with heating power in the same way as for two pulses, but the variation was less marked.

TABLE 5

| Invention example | Printing with three heating pulses per line time: heating power | printhead voltage | pulse-length | Print characteristics | | | |
|---|---|---|---|---|---|---|---|
| number | [W/mm$^2$] | [V] | [ms] | $D_{vis}$ | L* | a* | b* |
| 46 | 24.2 | 18.0 | 1.02 | 2.23 | 4.94 | 2.42 | 1.71 |
| 47 | 21.6 | 17.0 | 1.15 | 2.15 | 5.72 | 4.25 | 2.69 |
| 48 | 18.4 | 15.7 | 1.33 | 2.28 | 4.46 | 1.95 | 1.21 |
| 49 | 14.7 | 14.0 | 1.66 | 2.26 | 4.77 | 1.32 | 0.31 |
| 50 | 12.9 | 13.1 | 1.92 | 2.37 | 3.75 | 0.71 | 0.07 |
| 51 | 9.83 | 11.5 | 2.55 | 2.37 | 3.83 | 0.42 | −0.39 |

In conclusion for a given dot energy in the case of multiple pulses it is beneficial for image density and image tone to use the lowest heating power possible and thereby correspondingly longer heating pulses. This is particularly beneficial when two pulses are used per line time. In the case of a single pulse, which for technical reasons is less favourable, due to greater drain on a DC-power source and greater thermal head temperature fluctuation during printer resulting in less reliable transport of the black and white substantially light-insensitive thermographic recording material and greater abrasion of the thermal head, is less interesting, there is little dependence of image density and image tone upon heating power.

Having described in detail preferred embodiments of the current invention, it will now be apparent to those skilled in the art that numerous modifications can be made therein without departing from the scope of the invention as defined in the following claims.

What is claimed is:

1. A printing process for a substantially light-insensitive thermographic monosheet material having two edges parallel to one another and >12 cm apart (non-label) for obtaining a desired optical density and a desired colour tone comprising:

selecting a thermographic monosheet material, said selected thermographic monosheet material being a black and white thermographic monosheet material having a support and a thermosensitive element;

supplying image data to a processing unit of a thermal printer including a printhead having energizable heating elements arranged in a column C;

converting said image data which are not zero into at least one activation pulse per pixel to be printed;

energising said heating elements printing-line by printing-line adjacent to said selected thermographic monosheet material thereby producing an image;

transporting said imaging material past and adjacent to said printhead in a transport direction with a transport system;

forming an image dot with a heat energy of 50 to 200 $mJ/mm^2$ of heating element surface area;

wherein said thermosensitive element contains a substantially light-insensitive organic silver salt, a reducing agent therefor in thermal working relationship therewith and a binder; and said thermosensitive element excludes a colourless or light coloured dye precursor and and also excludes an encapsulated organic silver salt in a heat-responsive microcapsule.

2. Printing process according to claim 1, wherein said two parallel edges of said thermographic monosheet material are separated by a distance of >12 cm measured perpendicular to said parallel edges.

3. Printing process according to claim 1 further comprising selecting the supply-voltage, which determines the heating power, the column-time, and/or the column-duty-cycle $\nabla$ for obtaining said optical density and said colour tone with said selected thermographic monosheet material.

4. Printing process according to claim 3, wherein in said energising of said heating elements said heating power is as low as possible and said column-duty-cycle $\nabla$ is as high as possible in achieving a particular heat energy for the formation of said image dot.

5. Printing process according to claim 4, wherein said energisable heating elements are grouped in at least two sections S of energisable heating elements.

6. Printing process according to claim 1, wherein said printhead consists of more than one column of energisable heating elements.

7. Printing process according claim 1, wherein said energising of the heating elements printing-line by printing-line is carried out section by section.

8. Printing process according claim 1, wherein a configuration memory contains characteristics of at least one thermographic monosheet material relating to a range of available column-times, to a range of available transportation speeds, to a range of available voltages.

9. Printing process according to claim 8, wherein said selection of the supply-voltage, the column-time and/or the column-duty-cycle $\nabla$ for obtaining said optical density and said colour tone with said selected thermographic monosheet material includes:

generating a signal indicative of said thermographic monosheet material;

retrieving from said configuration memory values for the supply-voltage, for the column-time and for the column-duty-cycle $\nabla$ corresponding to said optical density and said colour tone for said selected thermographic monosheet material.

10. Printing process according to claim 1, wherein the heating power per heating element in said energization of heating elements is in accordance with $P \leqq P_{max}=3.3\ W/mm^2+(9.5\ W/mm^2 \times \nabla)$, where $P_{max}$ is the maximal value over all said heating elements of the time averaged power density P (expressed in $W/mm^2$) dissipated by said heating element during said column-line-time.

11. Printing process according to claim 1, wherein said black and white substantially light-insensitive thermographic recording material has a numerical gradation value, NGV, greater than 2.0, where the numerical gradation value is defined as:

$$NGV=(0.9+D_{min})-(0.1+D_{min})\ E(0.9+D_{min})-(0\ 1+D_{min})$$

where $E(0.9+D_{min})$ is the heat energy for the formation of an image dot with an optical density of $0.9+D_{min}$ and $E(0.1+D_{min})$ is the heat energy required for the formation of an image dot with an optical density of $0.1+D_{min}$.

12. Printing process according to claim 1, wherein the organic silver salt is a silver salt of an aliphatic carboxylic acid.

* * * * *